US008127932B2

(12) United States Patent
Trench et al.

(10) Patent No.: US 8,127,932 B2
(45) Date of Patent: Mar. 6, 2012

(54) SCREEN MODULE FOR VIBRATORY SCREENING APPARATUS

(75) Inventors: Michael Trench, Warner (AU); Sasha Birtasevic, Forest Lake (AU); George Gruevski, Greenbank (AU); Kishor Ravi Thekkuveetil, Clayfield (AU)

(73) Assignee: Ludowici Australia Pty Ltd, Pinkenba, Queensland (AU)

( * ) Notice: Subject to any disclaimer, the term of this patent is extended or adjusted under 35 U.S.C. 154(b) by 156 days.

(21) Appl. No.: 12/309,903

(22) PCT Filed: Aug. 1, 2007

(86) PCT No.: PCT/AU2007/001074

§ 371 (c)(1),
(2), (4) Date: Aug. 12, 2009

(87) PCT Pub. No.: WO2008/014552

PCT Pub. Date: Feb. 7, 2008

(65) Prior Publication Data

US 2009/0301945 A1 Dec. 10, 2009

(30) Foreign Application Priority Data

Aug. 1, 2006 (AU) ..... 2006904206

(51) Int. Cl.
*B07B 1/46* (2006.01)

(52) U.S. Cl. ..... 209/405; 209/319; 209/409

(58) Field of Classification Search ..... 209/319, 209/405, 408, 409, 412
See application file for complete search history.

(56) References Cited

U.S. PATENT DOCUMENTS

| | | | | |
|---|---|---|---|---|
| 3,390,771 | A * | 7/1968 | Wehner | 209/365.1 |
| 5,755,334 | A * | 5/1998 | Wojcik et al. | 209/399 |
| 6,253,926 | B1 * | 7/2001 | Woodgate | 209/399 |
| 6,715,613 | B2 * | 4/2004 | Eeles et al. | 209/405 |
| 7,090,083 | B2 * | 8/2006 | Russell et al. | 209/405 |
| 7,467,715 | B2 * | 12/2008 | Johnson et al. | 209/405 |
| 7,841,476 | B2 * | 11/2010 | Johnson et al. | 209/405 |
| 2002/0056667 | A1 | 5/2002 | Baltzer et al. | |
| 2006/0196813 | A1 * | 9/2006 | Kadel | 209/405 |
| 2009/0166268 | A1 * | 7/2009 | Malmberg | 209/405 |

FOREIGN PATENT DOCUMENTS

| | | |
|---|---|---|
| AU | 19011/97 | 7/1997 |
| AU | 93275/98 | 1/1999 |
| WO | 00/53343 | 9/2000 |
| WO | 03/051536 | 6/2003 |
| WO | 2005/051554 | 6/2005 |

* cited by examiner

*Primary Examiner* — Joseph C Rodriguez
(74) *Attorney, Agent, or Firm* — Howard & Howard Attorneys PLLC

(57) ABSTRACT

The invention provides a screen module for use on vibratory screening apparatus. The screen module includes: a panel frame having opposed side portions joined by opposed end portions, the end portions being configured for locating the panel frame between spaced panel support rails of the vibratory screening apparatus; at least one intermediate portion extending between the opposed side portions and/or opposed end portions and dividing the panel frame into panel portions; the side portions and said at least one intermediate portion having engagement formations provided on upper surfaces thereof that, together with engagement formations provided on each of the panel support rails of the vibratory screening apparatus, in use, form peripheral panel engagement formations about the panel portions; and at least one pair of screen panels, said screen panels overlying respective panel portions of the panel frame and including complementary engagement formations on an underside periphery thereof for engagement with the peripheral panel engagement formations, defined by the engagement formations of the panel frame and panel support rails.

6 Claims, 9 Drawing Sheets

SECTION A-A

SECTION A-A

DETAIL C

SECTION B-B

SCREEN MODULE FOR VIBRATORY SCREENING APPARATUS

FIELD OF THE INVENTION

The present invention relates to a screen module for vibratory screening apparatus. In particular, the invention relates to screen modules including a frame and removable screening panels for vibratory screening apparatus, and screening panels for use in such modules.

BACKGROUND TO THE INVENTION

In the art of vibratory screening apparatus, there are advantages in the use of polymeric screening members. Certain polymers, such as polyurethanes, may be used in lieu of fabricated metal screens in cases where the superior resistance to abrasive wear possessed of polyurethane is an advantage. Polyurethane screening members may be moulded in a wide variety of forms with ease, as opposed to the limitations in fabricating metal screens. Most polyurethane screening members incorporate edge and intermediate reinforcing of steel or other reinforcing to rigidly support the screen surface thereon.

Screening panels may be monolithic, where the screening surface and panel body are moulded monolithically over a frame. Alternatively screens may include a frame over which a poly body is formed, the poly body having upper clipping arrangements provided on the top of the over-moulded frame elements to enable the screening element or "skin" to be removably attached. In such cases, skins may be replaced when worn without the need to replace the panel body. Whilst the skins may be more readily replaceable, due to their design in use they flex and allow the openings through the screen to become distorted which allows larger particles than intended to pass through the screen, which results in the screen failing to grade to a sharp cut-off of particle size.

Australian Patent 559443 (FIORIS) discloses a variety of screen member constructions comprising screen member modules, most having steel reinforced edge portions. The modules are adapted to be assembled in multiples to a support structure, adjacent modules abutting with complementary halves of a bead arrangement adapted to engage a profile support bar which retains the modules in relative location. In one embodiment of FIORIS, there is provided an unreinforced screen panel or skin adapted to snap into a stiffening grid of support bars assembled longitudinally and transversely to a conventional screen deck.

The upper edges of the longitudinal and transverse members have reentrant section grooves into which corresponding beads of adjacent unreinforced screen panels are inserted and retained thereby. This construction has the advantage that the screen panels are readily replaceable, the worn panels are replaceable, and the screen assembly in use presents an uninterrupted, flat screen surface. The disadvantages are that the screen panels are necessarily small since the span of the flexible polyurethane material comprising the screen panel must be controlled to prevent undue distortion by flexing in use, at reasonable web thicknesses. The smallness of the panels with their peripheral mounting portions reduces the effective screen area. The supporting grid of longitudinal and transverse members is a complicated arrangement of interlocking steel cored polyurethane pieces. The arrangement described in FIORIS is particularly difficult and costly to manufacture.

There are other examples of screening members formed of polyurethanes without reinforcing which are cheaper to manufacture and more easily replaceable than reinforced screens. In Australian Patent Specification AU-A-19011/97 (LETELA) there is provided a modular arrangement whereby a rigid, supporting reinforced polyurethane frame member is adapted to support an unreinforced polyurethane screen panel of large size by virtue of having intermediate support portions. The screen panels are moulded having a peripheral bead adapted to engage with peripheral grooves in the side edges of the frame members to secure the panels thereon. The end portions of the panels and frames overlying the standard-pitch (24" or approximately) screen deck support bars are adapted to be engaged by and secured to the deck support bars by a lower, bolted-down portion adapted to receive the frame and panel ends, and a locking piece overlaying the panel end edges and engaging the bolted down portion.

This arrangement goes some way to overcoming the disadvantages of the FIORIS apparatus. However, the screening panel is only retained against downward flexing on the intermediate support bar. In practice the screening panels allow the screening web to impact on the intermediate support, which in turn suffers from impact or fatigue tearing of the screening panels that gives the appearance of a cut failure. Polyurethanes are resistant to abrasion wear but are susceptible to cut damage. The screening panels reach sufficient amplitude in upward vibration to cause some loss of grade control in screening. The securing means intrudes onto the plane of the screening surface thus tending to interrupt free flow of particles across the screening surface.

International Patent Publication WO 00/53343 discloses a screening module for a vibratory screen deck including a screen support member that is releasably securable to the screen deck and having a peripheral frame and an intermediate strut, and a polymeric screen member engaged by snap-in connection with each of the peripheral frame portion and the intermediate strut the intermediate strut being located so that flex of the polymeric screen member is controlled.

This construction overcomes the flogging failure mode of the FIORIS and LETELA apparatus. The skins are provided in 1' square half-panel units, and are able to be inserted with the screening slots oriented either along the 2'×1' panel frame long axis or transverse to it. However, the skins have to be installed on the panel frames after the frames are installed to a screen machine having a bolt-up panel support frame. Also the system mandatorily eliminates skin flex; the operator does not have the option of allowing skin flex such as where a sticky clay type material is being processed.

SUMMARY OF THE INVENTION

The invention advantageously provides an alternative screen module for vibratory screening apparatus. In certain embodiments the module advantageously alleviates excessive flex of the screen panel, while facilitating a degree of flex desired for a particular application without resulting in excessive wear of the screen panel. Also, in certain embodiments the module advantageously facilitates easy assembly of the module on the apparatus and economical replacement of wearing parts.

In one aspect the present invention resides broadly in a screen module for vibratory screening apparatus including:

- a panel frame having opposed side portions joined by opposed end portions, the end portions being configured for locating the panel frame between spaced panel support rails of the vibratory screening apparatus; at least one intermediate portion extending between one or both the opposed side portions and/or opposed end portions and dividing the panel frame into panel portions; the side portions and said at least one intermediate portion having engagement formations provided on upper surfaces thereof that, together with engagement formations provided on each of the panel support rails of the vibratory screening apparatus, in use, form peripheral panel engagement formations about the panel portions; and at least one pair of screen panels, the screen panels overlying respective panel portions of the panel frame and including complementary engagement formations on an underside periphery thereof for engagement with the peripheral panel engagement formations, defined by the engagement formations of the panel frame and panel support rails.

The screen panels may be made of any suitable metal or a flexible polymer material. Preferably the screen panels are made of a flexible polymer material. The flexible polymer material may be any suitable polymer material the properties of which make it suitable for use in screening panels, such as moulded elastomeric materials, polyurethane elastomer materials, natural rubber, synthetic rubber or the like. The screen panels generally include screening apertures. However, in particular applications the screen panels may be blank or contain no screening apertures.

The panel frame is rigid and usually formed from metal such as steel or stainless steel, but may be of other suitable material such as fibre-reinforced polymer materials, polymer composite materials, or rigid polymers such as acrylonitrile butadiene styrene (ABS) and the like.

The end portions may be configured in any way to allow the panel frame to be located on the spaced panel support rails of the screening apparatus. For example, the end portions may include end faces configured to allow clipping or frictional engagement of the panel frame to the screening apparatus by downward pressure on the end portions. The downward pressure may be exerted before or after installation of the panel screens on the panel frame. In one embodiment, the end portions have tapered lateral end faces that engage oppositely tapered faces provided on the panel support rails. The tapered end faces of the panel frame and tapered faces of the panel support rails are preferably provided with complementary engagement formations that are engaged by urging the respective tapered faces past one another by driving the panel frame downward. The complementary engagement formations may for example comprise a continuous or discontinuous ridge and recess pair, or opposed ridges or barbs, on the respective tapered faces.

A rigid reinforcement member may be located inwardly of the tapered face of the respective end portions.

The intermediate frame portions extending between one or both of the opposed side and/or end portions and dividing the panel frame into panel portions are preferably reinforced with rigid members that are formed with reinforcing rigid members of the side portions and end portions.

The engagement formations on the side portions and intermediate portions of the panel frame, and the complementary engagement formations on the underside of the screen panel are not particularly limited. These formations ensure that the screen panels may be located on, and engaged with, the panel frame without resulting in any hindrance on the upper screening surface of the module. In a preferred embodiment, the engagement formations have a continuous or discontinuous clip-in profile to permit clipping of the screen panels to the side portions and intermediate portions of the panel frame and the support rails of the vibratory screening apparatus from above. The screen panels can preferably engage with the panel frame along the flow or across the flow of the machine. In that regard, the screen panels and the panel portions of the panel frame are preferably square or rectangular.

The screen panels are preferably formed of polymeric material such as polyurethane, or a natural or synthetic rubber. Preferably the polymer is recyclable.

In a preferred embodiment, the panel frame includes a sub-frame extending within each panel portion. For example, the sub-frame may include sub-frame portions extending between the end portions and the intermediate portions and/or sub-frame portions extending within each panel portion between the side portions. In one embodiment, the sub-frame includes cruciform portions within each of the panel portions. The sub-frame, including the above described sub-frame portions may also be reinforced with rigid members. This will be described in more detail below in regard to an alternative aspect of the invention.

If a sub-frame is included in the panel frame, each of the screen panels preferably includes a complementary web adapted to overlie a respective sub-frame portion. For example, if each panel portion of the panel frame includes a cruciform sub-frame, each screen panel preferably includes a complementary cruciform web. In such cases, the sub-frame portions are preferably provided with engagement formations and the webs of the screen panels are provided with complementary engagement portions. Preferably, the engagement formations of the sub-frame portions and the webs of the screen panels have a continuous or discontinuous clip-in profile that facilitates clipping of the webs of the screen panels to the sub-frame portions.

According to one particular embodiment, which is not necessarily preferred, each of the screen panels may include at least one connector, for example a moulded spigot, adapted to engage a complementary recess in the sub-frame, for example at the junction of a cruciform sub-frame portion. In one embodiment, there may be provided a spigot integrally formed on the screen panel and having a clip-in section adapted to clip into a complementary recess provided in the sub-frame. In this case, the connector may be considered selectively availability by means of selectively cutting off the connector, or spigot, from the screen panel.

Alternatively, there may be provided opposed clip in recesses in the screen panels and panel frame adapted to be selectively interconnected by double ended pins of polymer or metal. One or more of these double ended pins may be used at various locations to engage the screen panels and sub-frame. By altering the number and location of the double ended pins the degree of flex in the screen panel may be altered.

The screen panels of the screen modules of the invention preferably have in situ reversibility so that the screening apertures in the screen panels may be orientated towards or against the flow of material over the module. The screen panels themselves are not a structural member, but they do directly engage the panel support rails of the vibratory screening apparatus. The panel frame still carries all dynamic loading and most of the static loading.

The panel frame itself is engaged onto the panel support rails which are conventionally attached onto the structural members of the vibratory screening apparatus. The panel support rails provide two main functions. One is to hold down the frame, which is simply knocked onto the panel support rails and is preferably held in place by double edge taper end faces. The other is to provide an abutment, and final peripheral support, for neighbouring support frames, thereby providing a continuous and flush screen surface without the need for lock down bars as seen in the prior art. The support frame itself may be fully located onto the panel support rails via alignment lugs and it may be easily removed from the panel support rails via pry slots. It is expected that the panel frame will significantly outlast the screen panel. The invention therefore advantageously maximises replacement efficiency and reduces down time on site.

As mentioned above, the panel frame preferably includes a sub-frame, in which case the screen panels preferably include complementary webs that may be associated with, or engaged with, the sub-frame. Such an arrangement has been found to provide substantial advantages in that the sub-frame, and the engagement of the webs with the sub-frame provide added support and strength to the screen panel during operation.

To that end, according to another aspect of the invention there is provided a screen module for a vibratory screening apparatus including:

a panel frame having opposed side portions joined by opposed end portions, the end portions being configured for locating the panel frame between spaced panel support rails of the vibratory screening apparatus; at least one intermediate portion extending between one or both the opposed side portions and/or opposed end portions and dividing the panel frame into panel portions; the side portions and the at least one intermediate portion having engagement formations provided on upper surfaces thereof; and at least one pair of screen panels overlying respective panel portions of the panel frame and including complementary engagement formations on an underside periphery thereof for engagement with the engagement formations of the side portions and intermediate portions of the panel frame;

wherein the panel frame includes a sub-frame having sub-frame portions extending within each of the panel portions, the sub-frame portions including engagement formations provided on upper surfaces thereof, and wherein each of the screen panels includes a web that is complementary with a respective sub-frame portion, each web having an engagement formation on an underside thereof adapted to overlie and engage the engagement formation of the respective sub-frame portion.

The additional features described above with reference to the previous aspect of the invention may also be applicable to the aspect described in the immediately preceding paragraph.

According to yet another aspect of the invention there is provided a screen panel for use in a screen module as described above, the screen panel including:

engagement formations on an underside periphery thereof for engagement with complementary engagement formations of a panel frame to which the screen panel is to be engaged; and at least one web that is complementary with a respective sub-frame portion of the panel frame, each web having an engagement formation on an underside thereof adapted to overlie and engage an engagement formation of the respective sub-frame portion.

The additional features described above with reference to the previous aspects of the invention may also be applicable to the aspect described in the immediately preceding paragraph.

According to yet another aspect of the invention there is provided a screen module for a vibratory screening apparatus including:

a panel frame having opposed side portions joined by opposed end portions, the end portions being configured for locating the panel frame between spaced panel support rails of the vibratory screening apparatus; at least one intermediate portion extending between one or both the opposed side portions and/or opposed end portions and dividing the panel frame into panel portions; the side portions and the at least one intermediate portion having engagement formations provided on upper surfaces thereof; and at least one screen panel overlying the respective panel portions of the panel frame and including complementary engagement formations on an underside periphery thereof for engagement with the engagement formations of the side portions and intermediate portions of the panel frame;

wherein the panel frame includes a sub-frame having sub-frame portions extending within each of the panel portions, the sub-frame portions including engagement formations provided on upper surfaces thereof, and wherein each of the screen panels includes a web that is complementary with a respective sub-frame portion, each web having an engagement formation on an underside thereof adapted to overlie and engage the engagement formation of the respective sub-frame portion.

Again, features described above with reference to the preceding aspects of the invention may also be applicable to this aspect of the invention.

DETAILED DESCRIPTION OF THE INVENTION

More detailed embodiments of the invention will now be described with reference to the accompanying drawings. This description is provided for reference only and should not be construed as limiting on the invention in any way. Referring to the accompanying drawings.

Figure 1:
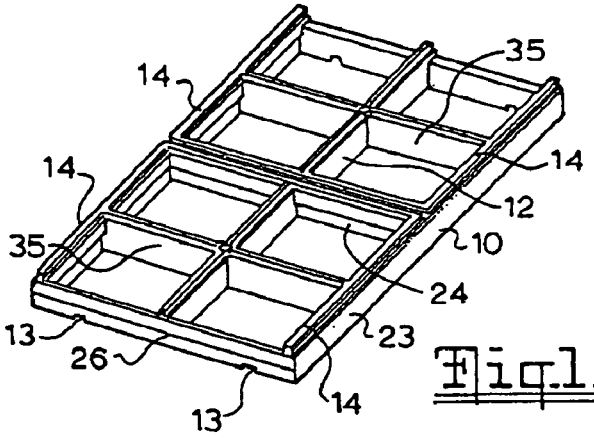
FIG. 1 is a perspective view of a panel frame.
Figure 2:
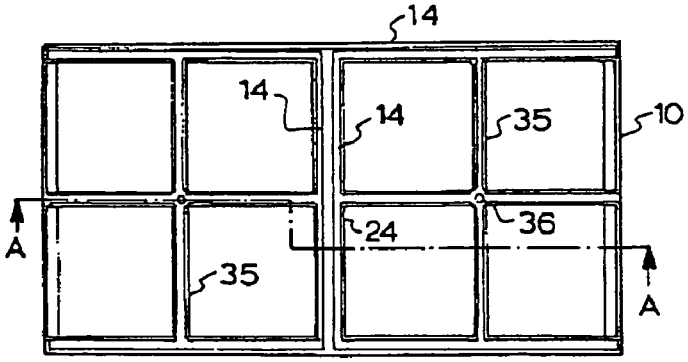
FIG. 2 is a plan view of the panel frame of FIG. 1.
Figure 3:
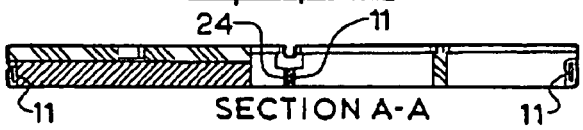
FIG. 3 is a section A-A through the panel frame of FIG. 2.
Figure 4:
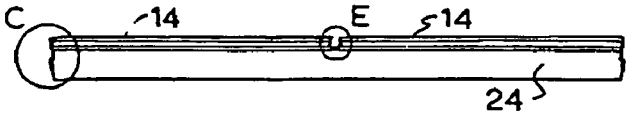
FIG. 4 is a side view of the panel frame of FIG. 1.

In FIGS. 1 through 13 components of a screen module according to one embodiments of the invention are illustrated. There is provided a screen panel frame 10 of the adapted to suit a 2' by 1' installation and comprising a stainless steel frame core 11 having resilient polymer frame body 12 moulded over it. The frame body 12 includes functional integral mouldings including alignment slots 13, and a pair of spaced, adjacent panel engagement formations 14.

Figure 7:
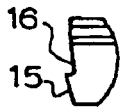
FIG. 7 is a detail view of the end profile of the panel frame of FIG. 4.

The end profile, best illustrated in FIG. 7, includes a tapered end face 15 bounded at its upper edge by a land 16. In use, the end profile is driven downward against an opposite tapered face 17 of a support rail 20, illustrated in FIG. 12, which tapered face 17 is bounded on its lower edge by a land 21 adapted to be engaged by the land 16 to retain the panel frame 10 between a pair of the support rails 20. The alignment slots 13 are adapted to engage corresponding alignment lugs 22 on the support rails 20.

Figure 5:
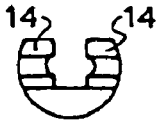
FIG. 5 is a detail view of the centre section of the panel frame of FIG. 4.
Figure 6:
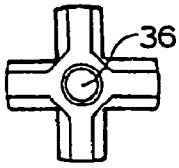
FIG. 6 is a detail view of the centre of sub-frame of the panel frame shown in FIG. 2.

Side portions 23 of the panel frame 10 are conjoined at their mid-points by an intermediate portion 24 dividing the plan of the panel frame 10 into two approximately square panel portions. The upper edges of the side portions 23 and intermediate portions 24 are provided with a respective moulded-in engagement formation 14 for each approximately square portion. As illustrated in FIG. 5, the engagement formations 14 are in relatively close and parallel proximity on the upper edge of the intermediate member 24. The respective formations 14 are accordingly a square U-shape in plan with the open part of the U extending along end portions 26 of the frame 10.

Figure 8:
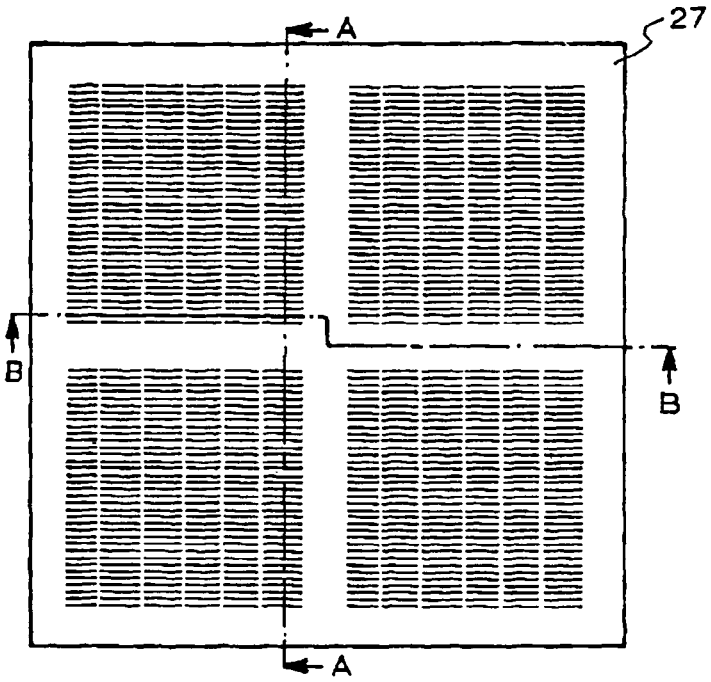
FIG. 8 is a top plan view of a screen panel suitable for use on the panel frame of FIG. 1.
Figure 10:
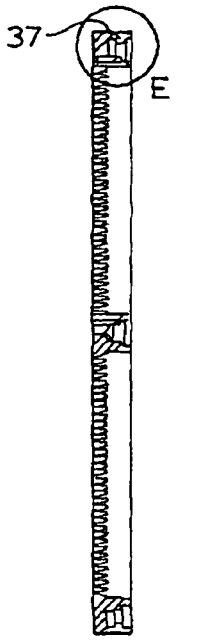
FIG. 10 is a section A-A through the screen panel of FIG. 8.
Figure 9:
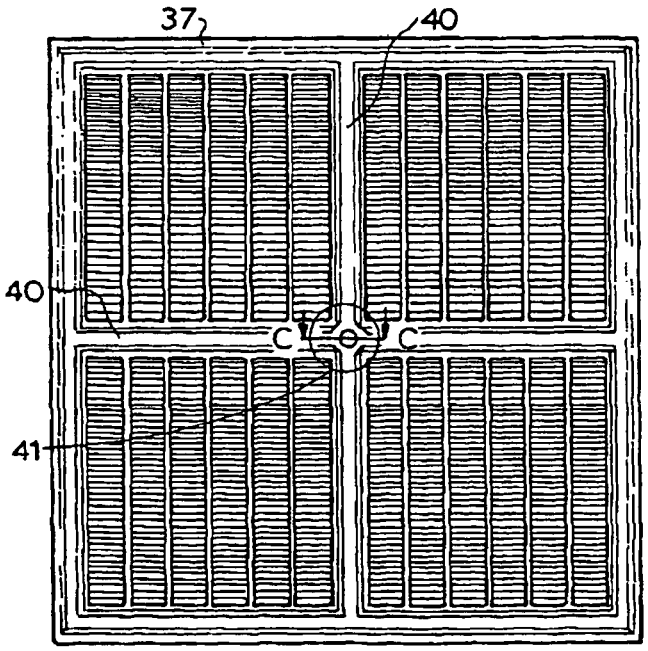
FIG. 9 is a is a bottom plan view of the screen panel of FIG. 8.
Figure 11:
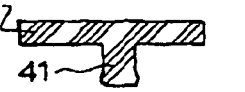
FIG. 11 is a section C-C through the centre of the screen panel of FIG. 9.
Figure 12:
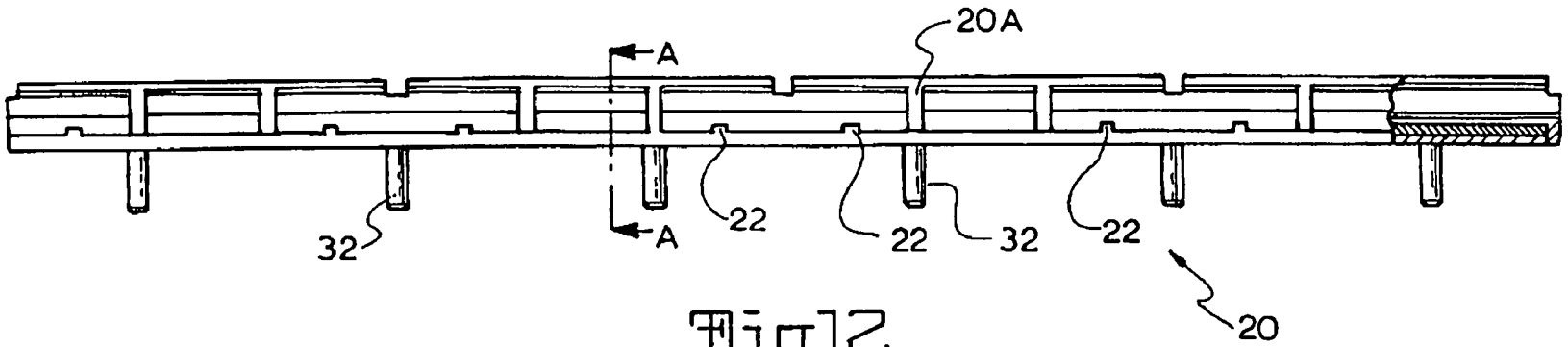
FIG. 12 is a side view of the support rail suitable for use in supporting one end of a panel frame according to FIG. 1.
Figure 13:
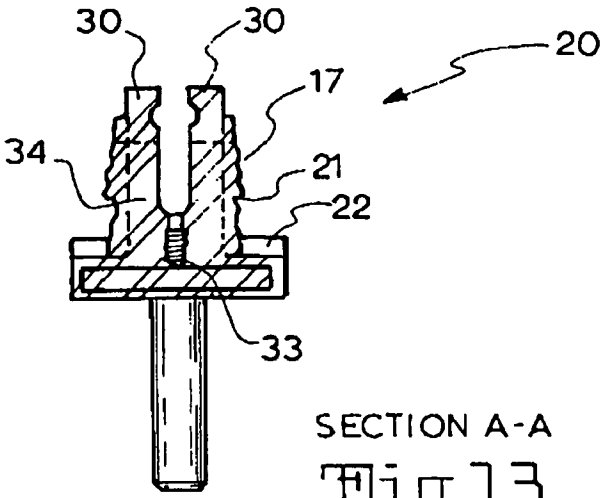
FIG. 13 is a section A-A through a support rail of FIG. 12.
Figure 14:
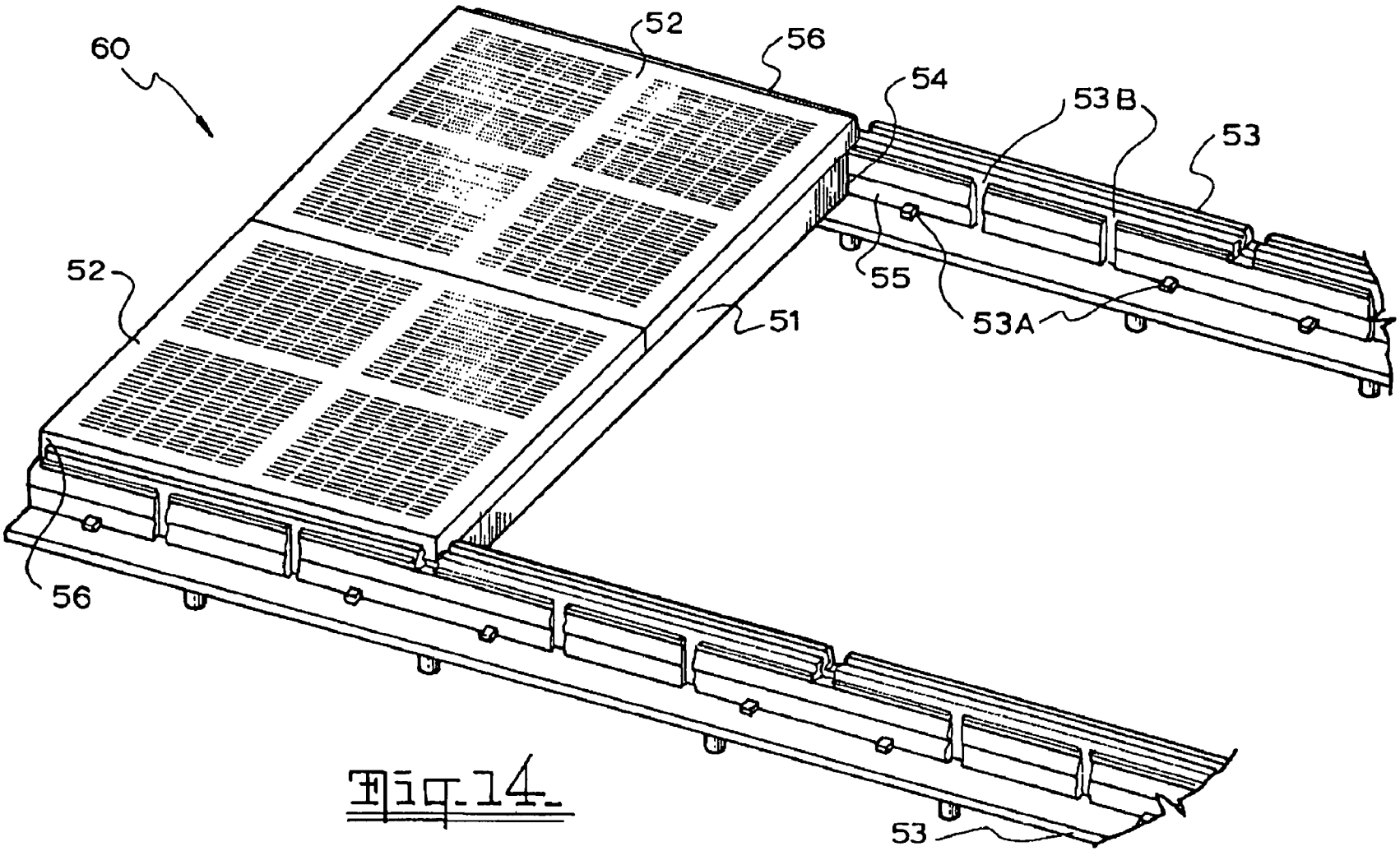
FIG. 14 is a perspective view of a partial assembled screen model, showing partial assembly of the articles of FIGS. 1, 8 and 12.
Figure 15:
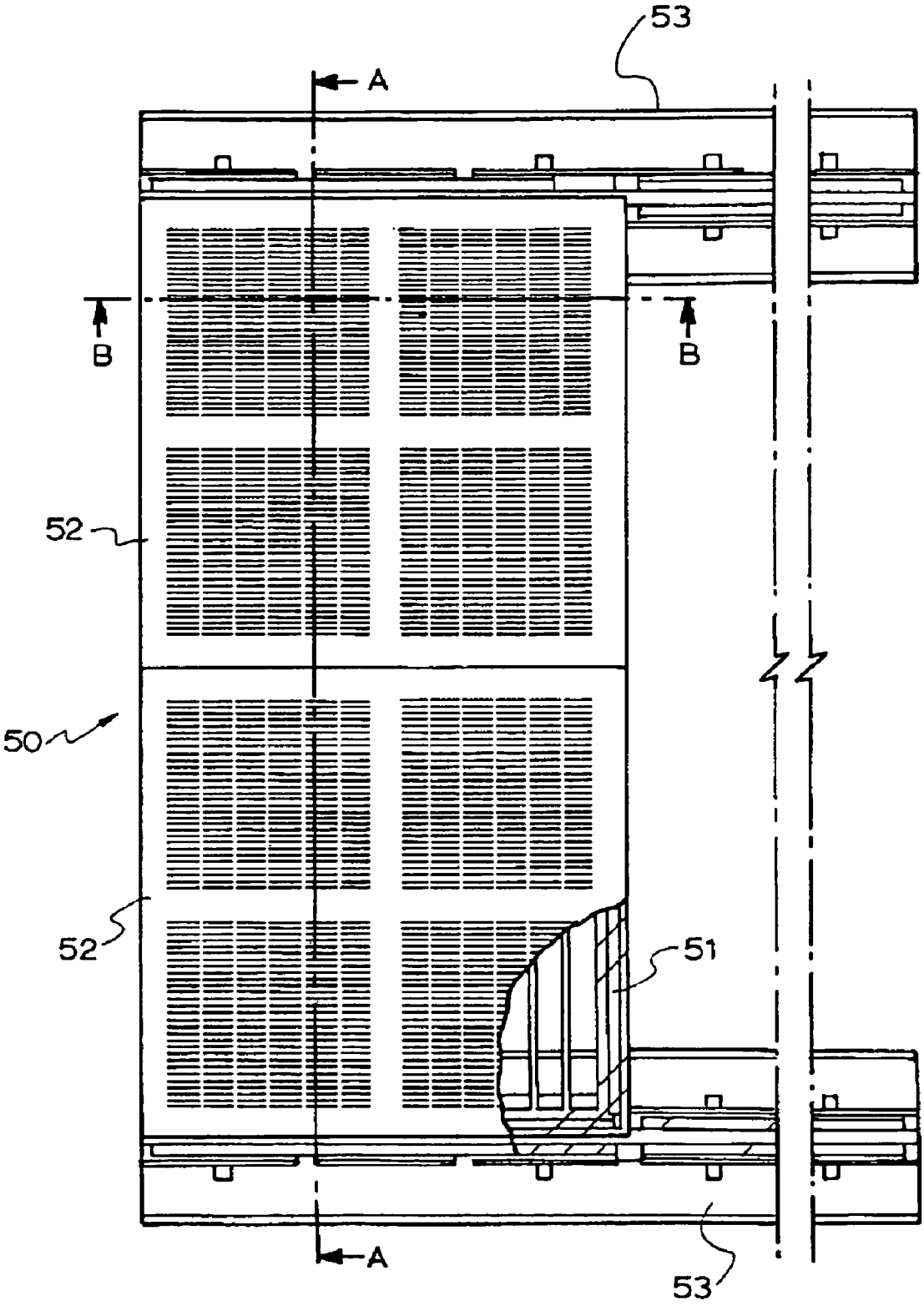
FIG. 15 is a partially cut away view of the screen module of FIG. 14.

The U-shaped plan of the formations 14 is made substantially continuous and capable of supporting a clip-in screen panel 27, as illustrated in FIG. 8, by virtue of a pair of opposed, spaced complementary engagement formations 30 on the top edge of the support rails 20.

The support rails 20 are further provided with pry slots 20A to enable removal of panel frames 10 and studs 32 permitting mounting to a screen machine. The rails 20 again have a metal core 33 over moulded by a polymer body 34.

The screen panel frame 10 has cruciform sub-frame portions 35 essentially quartering each of the substantially square panel portions and having an upper surface upon which the screen panels 27 may bear. The crux of the cruciform screen support portion is provided with a blind recess 36 having an internal annular groove (not shown).

The screen panels 27 have a screening surface with screening apertures and are bounded by a clip-in profile 37 adapted to enable the screen panels 27 to be clipped in to the panel frame 10. The screen panels 27 are square and have a cruciform web 40 to provide a bearing portion adapted to bear on the cruciform sub-frame portions 35 of the panel frame 10. The crux of the cruciform web 40 is provided by an integral spigot 41 (best illustrated in FIG. 11) which is adapted to positively engage the blind recess 36 to restrain the centre of the screen panel 27 in use. However, for screening clay materials or the like the spigots 41 can be nipped off to allow the skin 27 to flex more.

Components according to an alternative embodiment of the invention are illustrated in FIGS. 14 through 21. In this embodiment, a screen module 50 is provided including a panel frame 51 and screen panels 52. The module 50 is located between two support rails 53 (as previously described). The panel frame 51 includes tapered end faces 54 that engage complementary tapers 55 on the support rails 53. A rigid reinforcement member 54A is located inwardly of the tapered end faces 54.

The support rails 53 are provided with alignment lugs 53A to align the panel frame 51 onto the support rails 53. The support rails 53 are also provided with pry slots 53B which facilitate removal of the panel frames as required.

Figure 16:
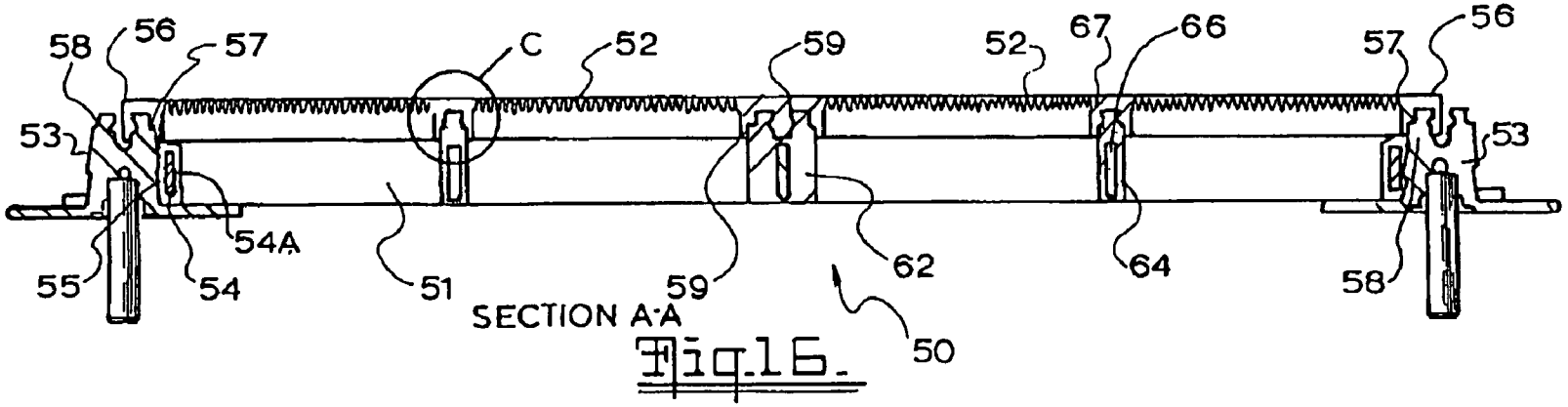
FIG. 16 is a section A-A through the screen module of FIG. 15.
Figure 17:
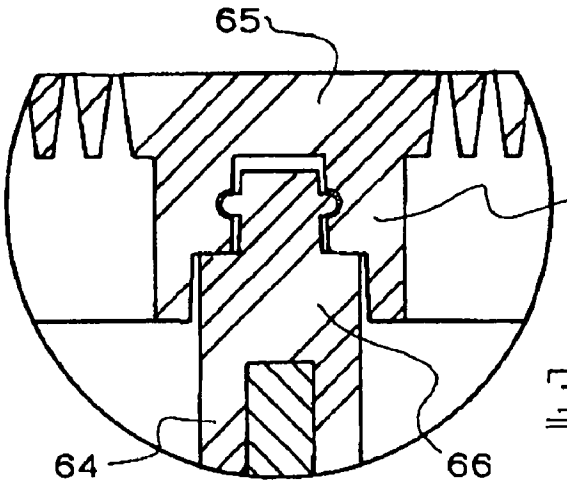
FIG. 17 is a detail view of the engagement formations illustrated in FIG. 16.
Figure 18:
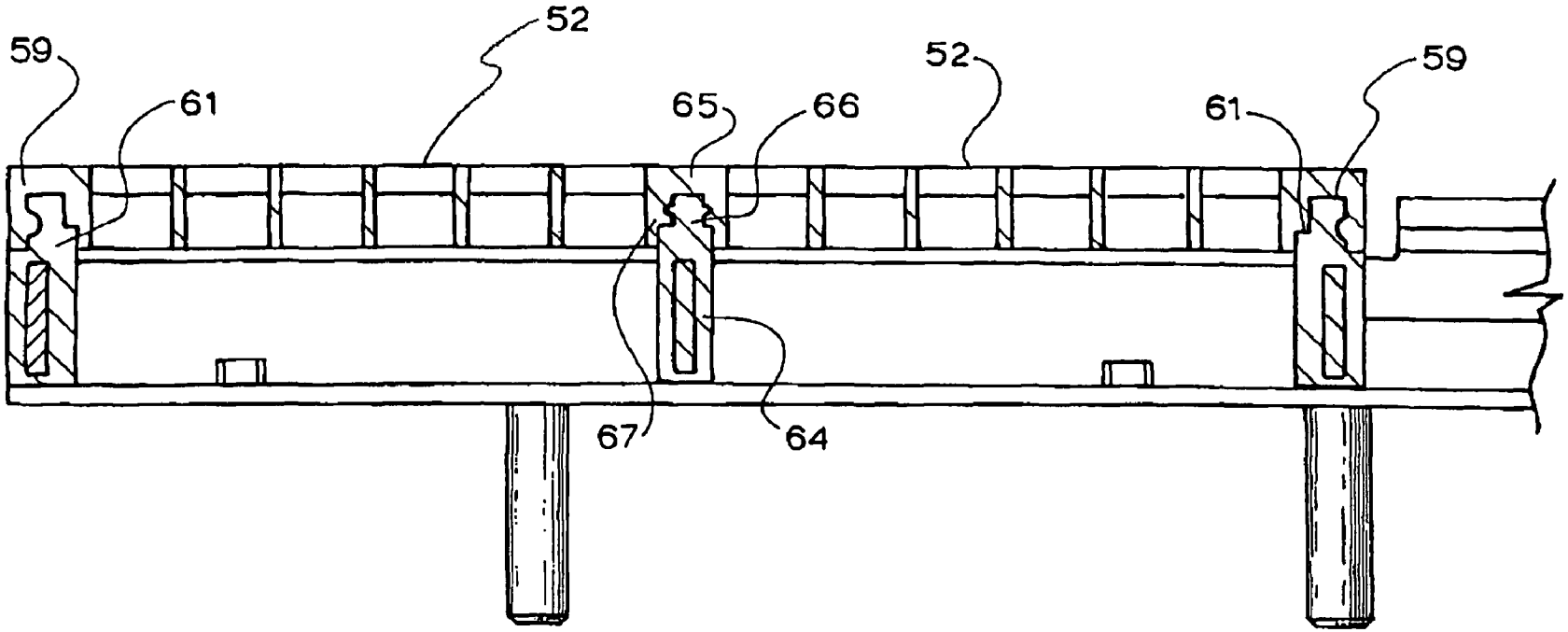
FIG. 18 is a section B-B through the screen module of FIG. 15.
Figure 19:
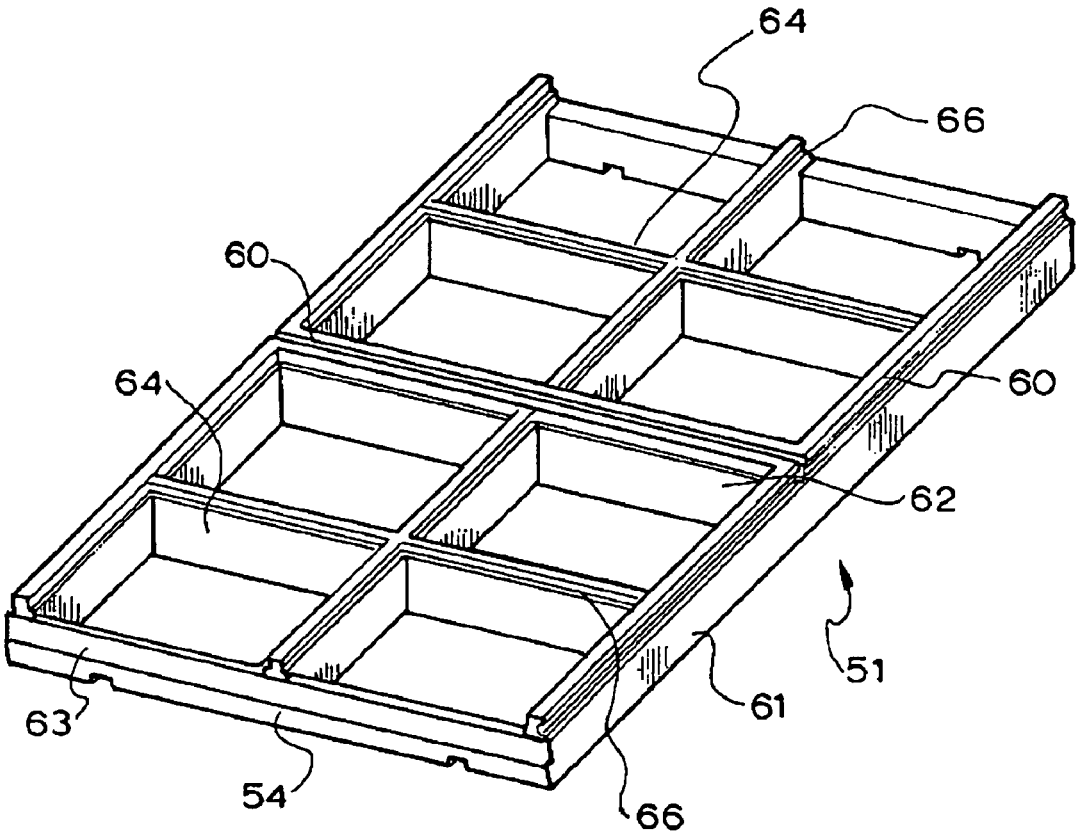
FIG. 19 is a perspective view of a panel frame.
Figure 20:
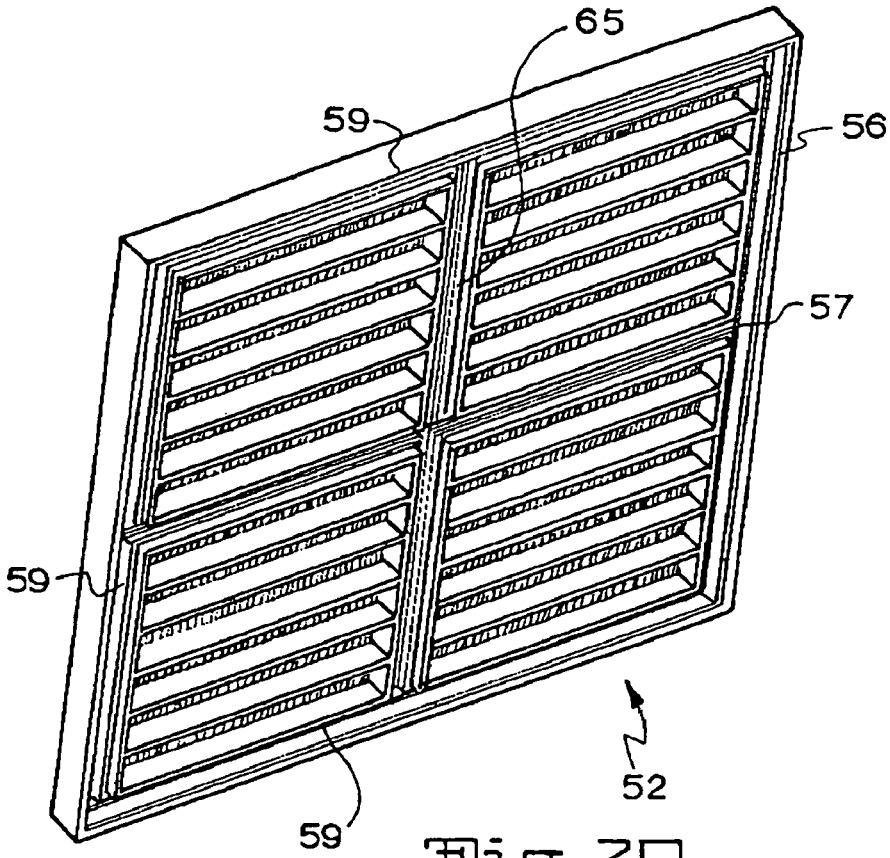
FIG. 20 is a perspective view of the underside of a screen panel.
Figure 21:
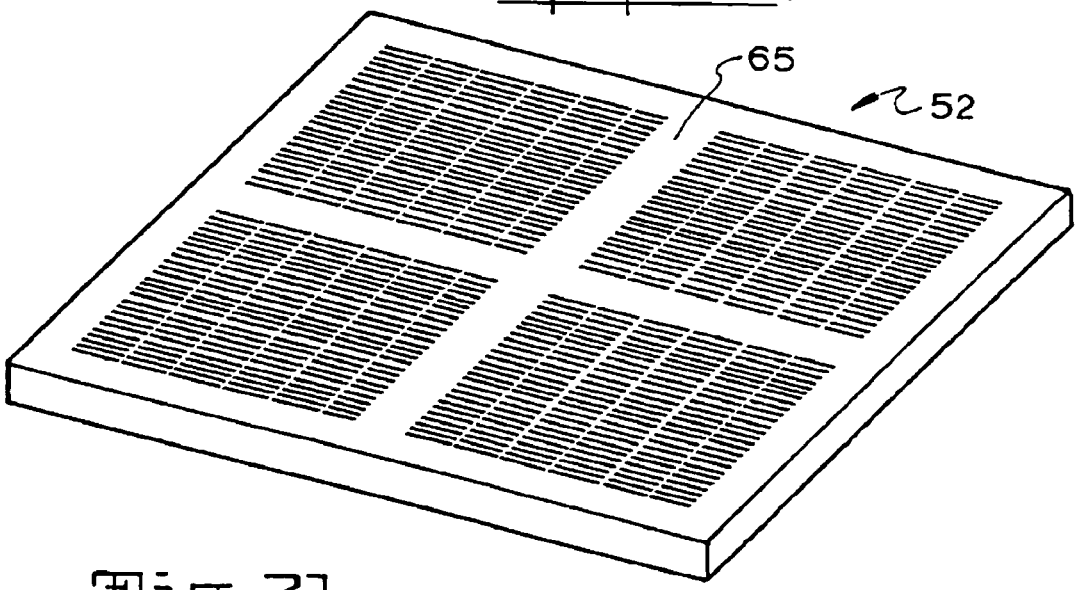
FIG. 21 is a perspective view of the upper side of a screen panel.

As best seen in FIG. 16, outer edges 56 of the screen panels 52 do not engage the panel frame 51. Rather, end portions 63 of the panel frame 51 are left without engagement formations and engagement formations 57 on the underside of the outer edges 56 of the screen panels 52 engage formations 58 on the support rails 53. This provides for a flat screening surface that is free from any hindrance. The remaining edges of the screen panels 52 also include engagement formations 59 on their undersides that engage formations 60 on side portions 61 and intermediate portions 62 of the panel frame 51.

The panel frame 51 is provided with a sub-frame including cruciform sub-frame portions 64. Likewise, as was the case with the previously described embodiment, the screen panels 52 are provided with a cruciform web 65. In use, the cruciform webs 65 of the screen panels 52 overlie the cruciform sub-frame portions 64. Further, the sub-frame portions 64 are provided with an engagement formation 66 that is engaged by formations 67 on the underside of the cruciform webs 65 of the screen panels 52.

Depending on the intended application, part or all of the cruciform web 65 of the screen panels 52 may be formed, for example moulded, without an engagement formation 67. This will enable greater flex of the screen panels 52 for particular applications. Generally, however, for many applications inclusion of the engagements formations 67 on the entirety of the cruciform web 65 will be appropriate. It will be appreciated that such an arrangement, which effectively divides the screen panels 52 into four sub-panels, may advantageously greatly improve wear resistance, while facilitating sufficient flex of the screen panel 52, but avoid over-flexing of the screen panel 52.

The engagement formations of the web and the sub-frame may alternatively both be in the form of corresponding recesses or channels which are engaged by locating one or more double ended pins. The number and location of these double ended pins may be varied to alter or control the degree of flex in the screen panel.

Altering or controlling the degree of flex which occurs in the screen panels during use may also be referred to as "tuning". The ability to "tune" the screen panel provides greater adaptability of the screen panels to screen different materials and under a range of conditions. For example, the stickier the product being screened the more flex that may be allowed into the screen, whilst when separating a free flowing product, for example soil/aggregate mixture, the screen panels may be fixed or engaged to minimise flex in the screen panel.

It will be appreciated that the above has been given by way of illustrative examples of this invention and that all such modifications and variations thereto as would be apparent to the person skilled in the art are deemed to fall within the broad scope and ambit of this invention as hereinbefore described.

The invention claimed is:

1. A screen module for vibratory screening apparatus including:

at least one pair of spaced apart panel support rails, each spaced apart panel support rail having rail engagement formations;

a panel frame having opposed side portions joined by opposed end portions, the end portions being configured for locating the panel frame between the spaced apart panel support rails;

at least one intermediate portion extending between the opposed side portions and/or opposed end portions and dividing the panel frame into panel portions;

the side portions and said at least one intermediate portion having frame engagement formations provided on upper surfaces thereof; and at least one pair of removable screen panels, said screen panels overlying respective panel portions and respective rails, wherein each screen panel has screen engagement formations to removably engage both respective rail engagement formations and frame engagement formations, wherein the end portions include end faces are configured to allow clipping or frictional engagement of the panel support rails of the screening apparatus by downward pressure on the end portions, wherein the end portions of the panel frame have tapered lateral end faces that engage oppositely tapered faces provided on the panel support rails, wherein the tapered lateral end faces of the panel frame are provided with engagement formations adapted to engage with complementary engagement formations on the tapered faces of the panel support rails.

2. The screen module according to claim 1, wherein the engagement formations of the tapered lateral end faces of the panel frame and the complementary engagement formations of the panel support rails comprise a continuous or discontinuous ridge and recess pair, or opposed ridges or barbs, on the respective tapered faces.

3. A screen module for vibratory screening apparatus including:

at least one pair of spaced apart panel support rails, each spaced apart panel support rail having rail engagement formations;

a panel frame having opposed side portions joined by opposed end portions, the end portions being configured for locating the panel frame between the spaced apart panel support rails;

at least one intermediate portion extending between the opposed side portions and/or opposed end portions and dividing the panel frame into panel portions;

the side portions and said at least one intermediate portion having frame engagement formations provided on upper surfaces thereof; and at least one pair of removable screen panels, said screen panels overlying respective panel portions and respective rails, wherein each screen panel has screen engagement formations to removably engage both respective rail engagement formations and frame engagement formations, wherein the panel frame includes a sub-frame extending within each panel portion, the sub-frame including sub-frame portions extending between the end portions and the intermediate portions and/or sub-frame portions extending within each panel portion between the side portions, wherein each of the screen panels includes a complementary web adapted to overlie a respective sub-frame portion.

4. A screen module for vibratory screening apparatus including:

at least one pair of spaced apart panel support rails, each spaced apart panel support rail having rail engagement formations;

a panel frame having opposed side portions joined by opposed end portions, the end portions being configured for locating the panel frame between the spaced apart panel support rails;

at least one intermediate portion extending between the opposed side portions and/or opposed end portions and dividing the panel frame into panel portions;

the side portions and said at least one intermediate portion having frame engagement formations provided on upper surfaces thereof; and at least one pair of removable screen panels, said screen panels overlying respective panel portions and respective rails, wherein each screen panel has screen engagement formations to removably engage both respective rail engagement formations and frame engagement formations, wherein the panel frame includes a sub-frame extending within each panel portion, the sub-frame including sub-frame portions extending between the end portions and the intermediate portions and/or sub-frame portions extending within each panel portion between the side portions, wherein each panel portion of the panel frame includes a cruciform sub-frame and each screen panel includes a complementary cruciform web.

5. The screen module according to claim 4, wherein the sub-frame portions are provided with engagement formations and the webs of the screen panels are provided with complementary engagement portions.

6. The screen module according to claim 5, wherein the engagement formations of the sub-frame portions and the webs of the screen panels have a continuous or discontinuous clip-in profile that facilitates clipping of the webs of the screen panels to the sub-frame portions.

* * * * *